United States Patent [19]

Allured et al.

[11] Patent Number: 4,653,376

[45] Date of Patent: Mar. 31, 1987

[54] ELECTRONIC SENSING SYSTEM FOR A STRINGED AND FRETTED MUSICAL INSTRUMENT

[76] Inventors: David Allured, 4231 Eaton Ct., Boulder, Colo. 80303; Leonard C. LaBanco, 2233 Arapahoe, Boulder, Colo. 80302

[21] Appl. No.: 652,730

[22] Filed: Sep. 21, 1984

[51] Int. Cl.[4] ..... G10H 3/18

[52] U.S. Cl. ..... 84/1.16; 84/1.18; 84/DIG. 30

[58] Field of Search ..... 84/1.16, 1.18, DIG. 2, 84/DIG. 30

[56] References Cited

U.S. PATENT DOCUMENTS

| | | | |
|---|---|---|---|
| 3,733,953 | 5/1973 | Ferber | 84/1.16 |
| 3,743,751 | 7/1973 | Ibanez | 84/1.16 |
| 3,851,265 | 11/1974 | Young, Jr. . | |
| 4,038,897 | 8/1977 | Murray et al. . | |
| 4,177,705 | 12/1979 | Evangelista . | |
| 4,292,875 | 10/1981 | Nourney | 84/1.16 X |
| 4,301,704 | 11/1981 | Nagai et al. . | |
| 4,306,480 | 12/1981 | Eventoff et al. . | |
| 4,321,852 | 3/1982 | Young, Jr. . | |
| 4,336,734 | 6/1982 | Polson . | |
| 4,372,187 | 2/1983 | Berg | 84/1.16 |
| 4,409,877 | 10/1983 | Budelman . | |
| 4,430,917 | 2/1984 | Pepper, Jr. . | |
| 4,430,918 | 2/1984 | Meno | 84/1.16 |
| 4,437,378 | 3/1984 | Ishida et al. . | |
| 4,468,997 | 9/1984 | Young, Jr. . | |

OTHER PUBLICATIONS

*Guitar Player*, vol. 18, No. 5, May 1984, copyright 1984 by GPI Publications, Cupertino, Calif. 95015, p. 30.

*Primary Examiner*—Stanley J. Witkowski
*Attorney, Agent, or Firm*—Robert E. Harris

[57] ABSTRACT

An electronic sensing system is disclosed for sensing fingering on a stringed and fretted musical instrument, such as a guitar, to produce therefrom electronic signals truly representative of the music created by the musical instrument. Sensing includes detection of the musical pitch created by each selected string and fret combination, as well as detection of the vibration state of the selected string and any pitch variations induced by the performer through string bending. The system is microprocessor controlled with each string of the instrument being successively and repeatedly sampled during playing of the instrument, and outputs indicative of the fret-string combination then being fingered, the vibration state, and any string bending are coupled to the microprocessor in digital form, and with the microprocessor then utilizing the then supplied information to provide an output suitable for coupling to a synthesizer to thereby enable performance of the music then being played by the performer utilizing the stringed and fretted musical instrument.

10 Claims, 13 Drawing Figures

38
40
PROGRAM ROM
MICRO-PROCESSOR
39
MIDI INTERFACE
42
TO SYNTHESIZER
41
CONTROL SWITCH & POTENTIOMETER
STRING SELECTION CIRCUITRY
43
35
44
FRET DETECTION UNIT
45
26(1-20)
24(1-6)
1 2 3 4 5 n
36
LEVEL DETECTORS
LEVEL OPTICAL PICKUP
71
BYPASS
OUTLET
95
BEND DETECTORS
37
STRAIN GUAGES
96

FIG. 6.
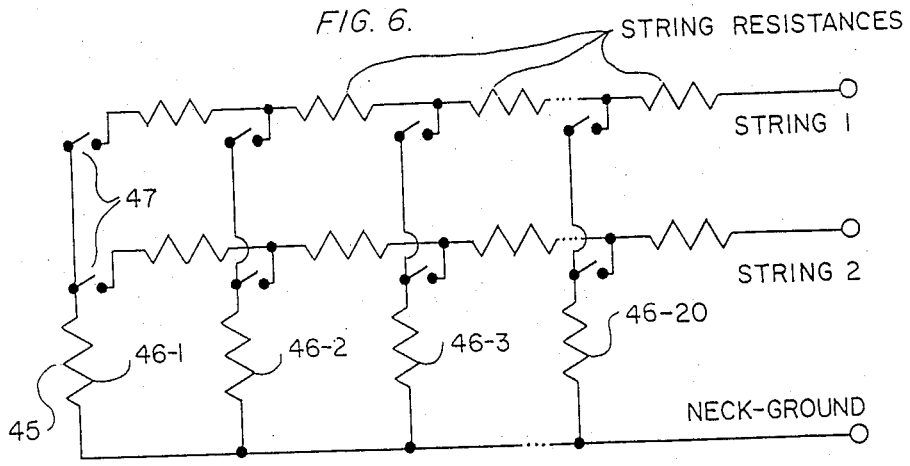
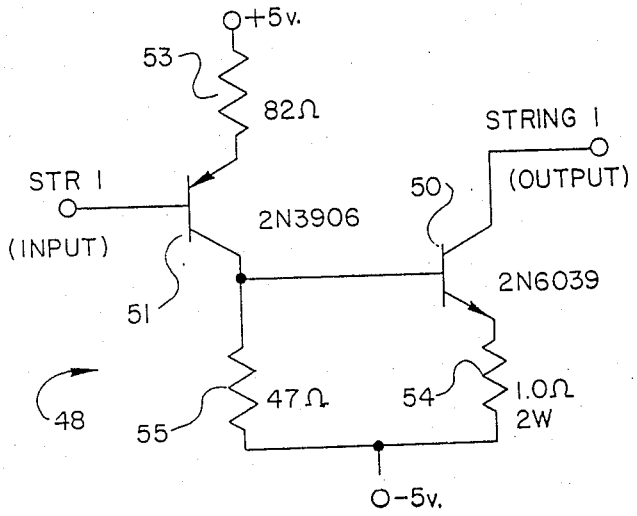
FIG. 7.

ELECTRONIC SENSING SYSTEM FOR A STRINGED AND FRETTED MUSICAL INSTRUMENT

FIELD OF THE INVENTION

This invention relates to musical instruments, and, more particularly, relates to an electronic sensing system for a stringed and fretted musical instrument.

BACKGROUND OF THE INVENTION

Stringed and fretted musical instruments, such as guitars, have long been well known, and, more recently, electronic stringed and fretted musical instruments have also been suggested and are widely utilized. Still more recently, microprocessor-based electronic musical instruments also have been suggested and/or utilized and have, heretofore, been utilized in conjunction with keyboards to provide a variety of pitch information (see, for example, U.S. Pat. Nos. 4,409,877, 4,301,704 and 4,437,378).

Electronic guitar sensing tone reproduction systems have also heretofore been suggested and/or utilized, and have included, for example, a system employing fret-linked switch detectors, tone reproduction oscillators and touch sensitive string activation circuitry (see U.S. Pat. No. 4,372,187).

SUMMARY OF THE INVENTION

This invention provides an electronic sensing system for use in conjunction with a stringed and fretted musical instrument. Sensing of the musical pitch of each string played is accomplished by a resistance-based fret-string detecting circuit operating under control of a microprocessor with the vibration state and bending of the strings to vary pitch being separately detected under the control of the microprocessor so that the resulting information conveyed to the microprocessor is utilized to produce an output suitable for coupling to a synthesizer to produce the music created by the performer utilizing the stringed and fretted musical instrument.

It is therefore an object of this invention to provide an improved sensing system for a stringed and fretted musical instrument.

It is another object of this invention to provide an improved sensing system for a stringed and fretted musical instrument suitable for use with a synthesizer.

It is still another object of this invention to provide an improved sensing system for a stringed and fretted musical instrument capable of creating electronic signals truly representive of the music created by the musical instrument.

It is still another object of this invention to provide an improved sensing system for a guitar.

It is still another object of this invention to provide an improved sensing system for a stringed and fretted musical instrument that is resistance-based with respect to detection of musical pitch.

It is yet another object of this invention to provide an improved sensing system that is microprocessor controlled having accurate pitch selection circuitry and synthesizer compatibility for greater musical versatility while preserving the musical instrument's inherent tactile and expressive qualities to the performer.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 6 is a simplified equivalent circuit of the fret-string circuitry;

FIG. 7 is a schematic diagram illustrating one string selective unit for string selection;

DESCRIPTION OF THE INVENTION

Figure 1:
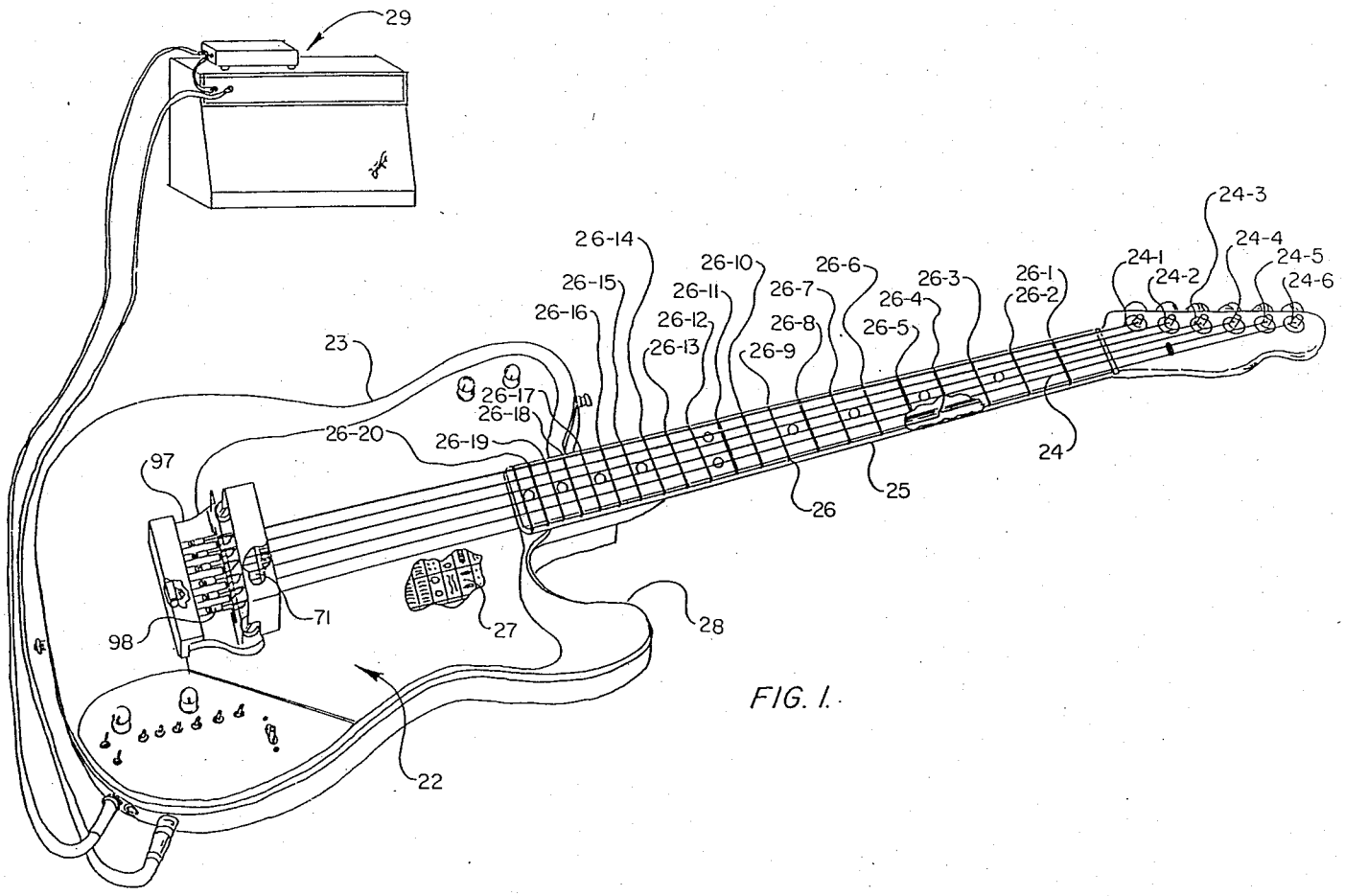
FIG. 1 is a perspective view of a stringed instrument (illustrated as a guitar) having the sensing system of this invention incorporated therein.

Referring now to the drawings, electronic sensor system 22 of this invention is shown in FIG. 1 incorporated into a stringed and fretted musical instrument (illustrated as a guitar) 23. Sensor system 22 detects the fingering of strings 24 (more specifically referred to as strings 24(1) through 24(6) for the six strings of a guitar) on a neck portion 25 having thereon frets 26 (more specifically referred to as frets 26(1) through 26(20) for the twenty frets commonly found on a guitar). The specific objective is to sense, for each string, the position of each selected fret contacting a string which determines the musical pitch of that string which may then be processed by the processing circuitry 27 positioned in the body portion 28 of the guitar (as shown in FIG. 1) and then coupled to a synthesizer 29.

Figure 2:
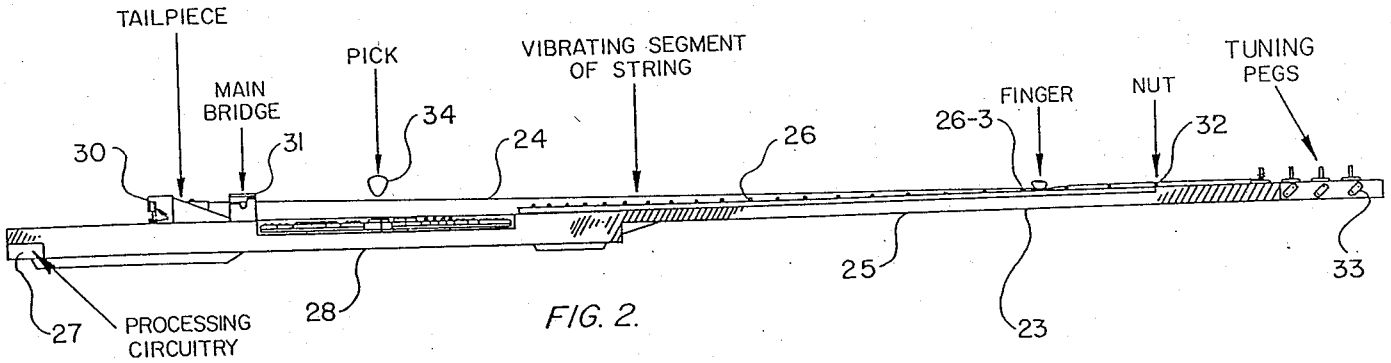
FIG. 2 is a side-sectional view of the guitar shown in FIG. 1.

In the ordinary fingering of a guitar neck by a performer, the performer's finger (indicated for illustrative purposes in FIG. 2) presses one or more strings downwardly toward the frets so that the string (or strings) contact one or more frets (which could, for example, include pressing a string down between two adjacent frets on the neck as indicated in FIG. 2). As also indicated in FIG. 2, the string, as is conventional, extends between a tail piece 30 over bridge 31 and nut 32 to tuning peg 33. The string is plucked or struck, commonly by a pick 34, between the frets 26 and bridge 31 so that string 24 vibrates and produces a musical note. The pitch of this thus produced musical note is determined primarily by the length of the free section of the string, between bridge 31 and the fingered fret contacting the string that is closer to bridge 31 (fret 26(3) in the example illustrated in FIG. 2). It is therefore important that the fret-sensing circuit determines which fret contacting the picked string is closest to bridge 31 (the closest fret is referred to herein as the "critical fret").

Figure 3:
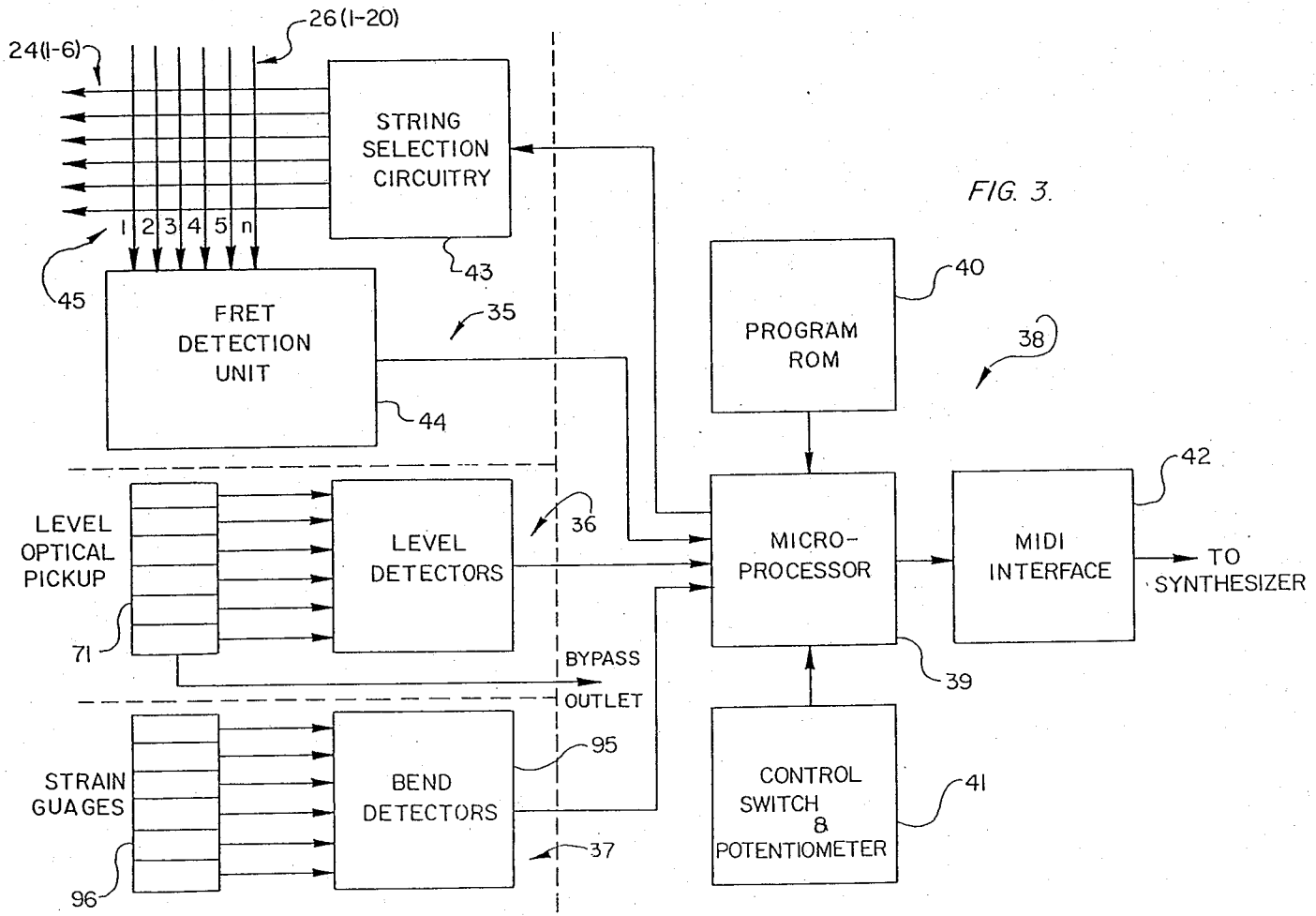
FIG. 3 is a block diagram illustrating the invention.

The sensory system of this invention includes three detecting sections, as shown in FIG. 3, including a fret-string detecting section 35, a string vibration detecting section 36 and a string bend detecting section 37. All three of these detecting sections provide interfaces with TTL-standard signals to a digital control system, which is specifically shown in FIG. 3 as a microcomputer 38.

As indicated in FIG. 3, microcomputer 38 includes a microprocessor 39, a program ROM 40 connected with microprocessor 39, control switch 41 connected with microprocessor 39, and MIDI interface unit 42 connecting microprocessor 39 with the synthesizer. As shown, microprocessor 39 provides an output to fret-string detecting section 35 to sequentially and repeatedly energize each string, as is necessary to determine the fret-string combination that is then being played (strings 24 and frets 26 are metallic and therefore electrically conductive). For a guitar having six strings and twenty frets, fret-string detecting section 35 receives six digital inputs from the microprocessor for string selection to successively energize each string for sensing purposes, and the microprocessor receives an output for each of the twenty frets on the guitar to indicate when that fret is the critical fret for the then selected (i.e., energized) string.

Fret-string detecting section 35 utilizes a resistance-based technique for determining the fret-string combination then selected with a resistance bridge network being established by the frets, strings and associated resistors in fret-string detecting section 35. Since metallic guitar strings have measureable electrical resistance, the string resistances between the frets and main bridge are used as elements of the resistance bridge network to discriminate the critical fret.

Figure 4:
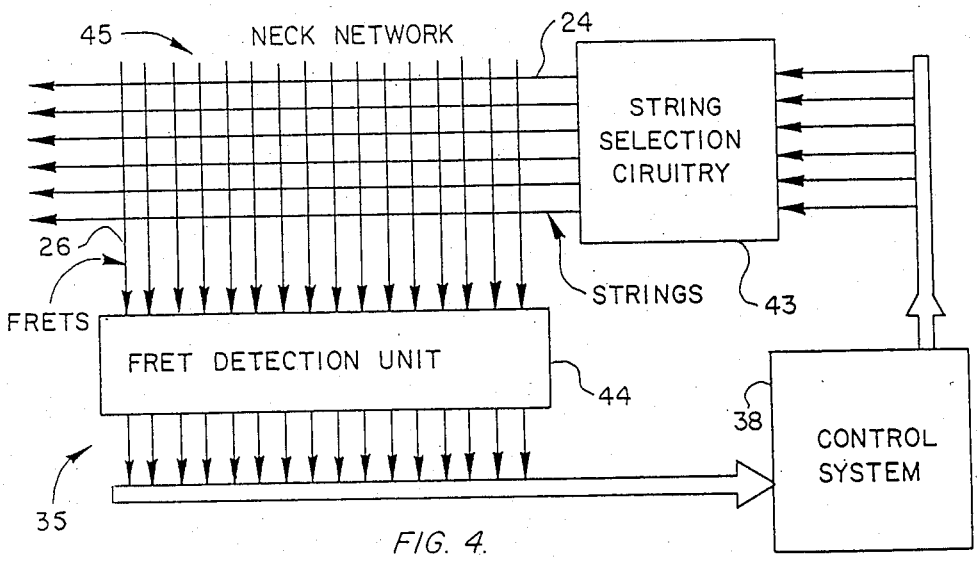
FIG. 4 is a block diagram of the fret-string detection circuitry shown in FIG. 3.

As indicated in FIGS. 3 and 4, strings 24 are connected with string selection circuitry 43 which receives the digital input signals from microcomputer 38, while frets 26 are connected with fret detector unit 44 which supplies digital output signals to microcomputer 38. Under control of the control system (microcomputer) 38, string selector 43 successively drives a DC current through each selected string, while leaving the other strings inactive. This current flows through the then selected string and fret combination of a neck network 45, causing voltage differences between the frets (when one or more frets are in contact with the then selected string). The neck network is designed to produce the most extreme voltage on the critical fret containing the then selected string. Fret detector 44 compares the voltages on all the frets, discriminates the most extreme one, and signals control system 38 through the corresponding output signals.

String selection circuitry 43, under the control of control system 38, steps through each of the six strings by successive energization of the strings, and reads the fret detector in each case (after a short settling delay). In this way, control system 38 uses this sensor to quickly, and repeatedly, obtain a complete reading of each guitar neck fingering.

This sensing technique works for either choice of polarity of current flow through the strings. In a working prototype (made in accordance with the invention as particularly described herein), the polarity has been chosen such that conventional circuit flow is from the neck network into the string selector circuit. Accordingly, the string selector circuits apply negative voltage to the strings, relative to the neck reference node (NECK-GROUND), and so the critical fret has a more negative voltage than the other frets.

Figure 5:
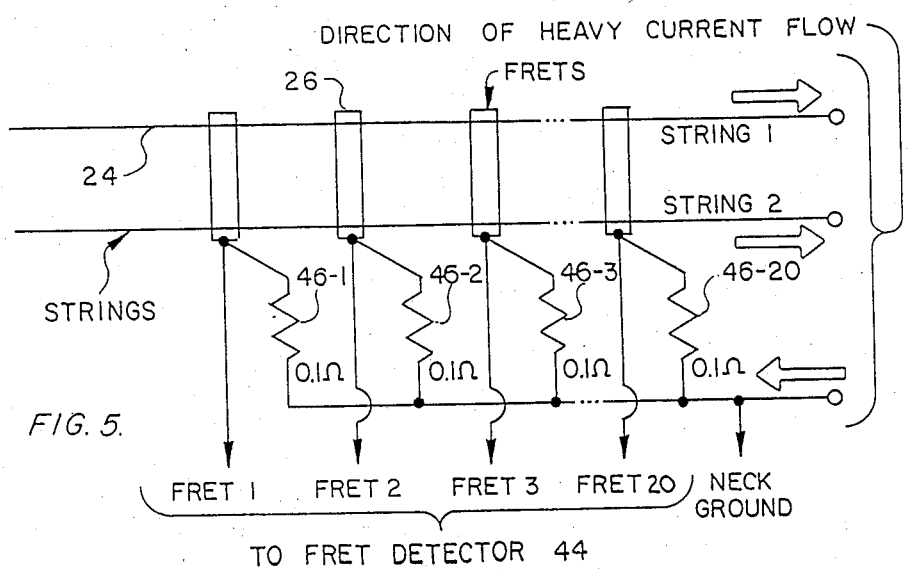
FIG. 5 is a simplified schematic circuit illustrating the fret-string circuitry at the neck of the guitar.

As shown, the neck network 45 includes strings 24 and frets 26 in their conventional arrangement on a guitar. In addition, and as shown in FIGS. 5 and 6, resistors 46 (designated particularly as 46(1) through 46(20) in the drawings) are connected with a different resistor 46 between each fret and NECK-GROUND. Strings 24 (for simplicity only two strings are shown in FIG. 5, but all of the strings are connected in the same manner as illustrated for strings 1 and 2 in FIG. 5) are connected to string selector 43 near bridge 31 for coupling input signals thereto. Frets 26 are connected to fret detector 44 (only four frets are illustrated, but a like connection is separately made for each fret as illustrated for the four frets as shown in FIG. 5).

The strings are electrically isolated from each other by insulated fittings or mountings at several points on the guitar. The frets are insulated from each other by their mounting on an ordinary non-conducting guitar neck.

When the fret board is fingered, electrical contacts are made between strings and frets at the points of physical contact therebetween. During such contact, electrical current flows from the string selector on the NECK-GROUND signal, through resistor (or resistors) 46, through the frets contacting an energized string, through the fret-string contacts, through the selected string (i.e., the string then energized) and then back to the string selector (which is connected with a power source).

Since each segment of string between two frets has electrical resistance and the string-fret contact functions as a switch 47 (considered an ideal switch herein), the neck circuit acts as a network of resistors and switches as illustrated in the equivalent circuit shown in FIG. 6. This network can be thought of as a multiple-node resistance bridge.

Current flowing through any fret must subsequently pass through that fret which is closest to bridge 31, and contacting the selected string, since the bridge 31 side of the selected string is the sole current return path to the string selector. Since all frets are separated by string resistance, this causes the circuit having the closest fret (i.e., the critical fret) to have a lower voltage than all other circuitry having the other frets therein.

A significant feature of this sensing technique is that it will properly discriminate the critical fret contacting the selected string, even in fingering patterns where frets even closer to the main bridge are connected to the critical fret through fingering contacts on other strings.

It is important to keep the contact resistance between strings and frets substantially lower than the resistance of string segments between frets (while conventional strings and frets made of, for example, stainless steel and brass may be utilized, the contact resistance could be further reduced, if needed, or desired, by gold-plating the strings and frets). The resistance of the frets (which are massive relative to the strings and are commonly made of brass) is very low, and therefore can be ignored.

String selector 43 includes six independently switchable constant-current drivers 48, one for each string. It is the function of the external control system 38 to supply logic signal inputs (STR1–STR6), to separately select each of the six strings.

Each constant-current driver 48 provides enough current to cause a suitable voltage difference between frets in worst-case fingering patterns, for example, those contacts at frets 26(18) through 26(20) where several strings 24 in that range are being fingered. The generated voltage difference between frets must be large enough to exceed the maximum input offset voltage error of the fret detector circuit. In an operating prototype, it was determined that a string current of 1.0 amps produced sufficient voltage difference between frets to enable satisfactory detection by the fret detector.

A typical constant-current string driver circuit 48 is shown in FIG. 7. This circuit switches the output current on when the TTL input is low (at appoximately 0.2 volts). The output current is off when the input is high (at approximately 2.0 to 5.0 volts). When the output is on (i.e., producing an output), a constant current of about 1.0 amps is produced. This current is approximately constant across the operating range of the STRING1–STRING6 output signals (from about −1.5 to 0.0 volts). When a string is not contacting any fret, the output current must drop to zero. In this case, transistor 50 saturates, and the STRING1–STRING6 output signal drops to about −4 volts.

Transistors 50 and 51 operate as inverting amplifying switches. They are both off when the circuit is "off", and both are in linear mode when the circuit is "on". Transistor 51 provides sufficient gain so that the input may be driven by an LS (Low-power Schottky) TTL device. Transistor 50 is a Darlington high-gain power transistor with an operating base-emitter voltage of about 1.4 volts.

Emitter resistor 53 is connected between the +5 volt power supply and the emitter of transistor 51, emitter resistor 54 (connected between the emitter of transmitter 50 and the −5 volt power supply) stabilizes the output current at approximately 1 amp, and the collector of transistor 51 is connected with the −5 volt power supply through resistor 55. Since only one output is normally on at a time, resistor 54 may be shared between all six string drivers.

Fret detector 44 compares the voltages appearing on all of the frets 26 through input signals (FRET1, FRET2, etc.), and discriminates, or detects, the lowest one. A signal is then supplied to the external control system through the corresponding logic signal output (F1, F2, etc.) to indicate the fret sensed to have the lowest voltage.

The voltage difference between the critical fret and adjacent frets can be very small, and can be, for example, as low as 5 millivolts with a string selector current at 1 amp. Therefore, it is important that the fret detector have a low input offset voltage error that is lower than the minimum expected inter-fret discrimination voltage.

Figure 8:
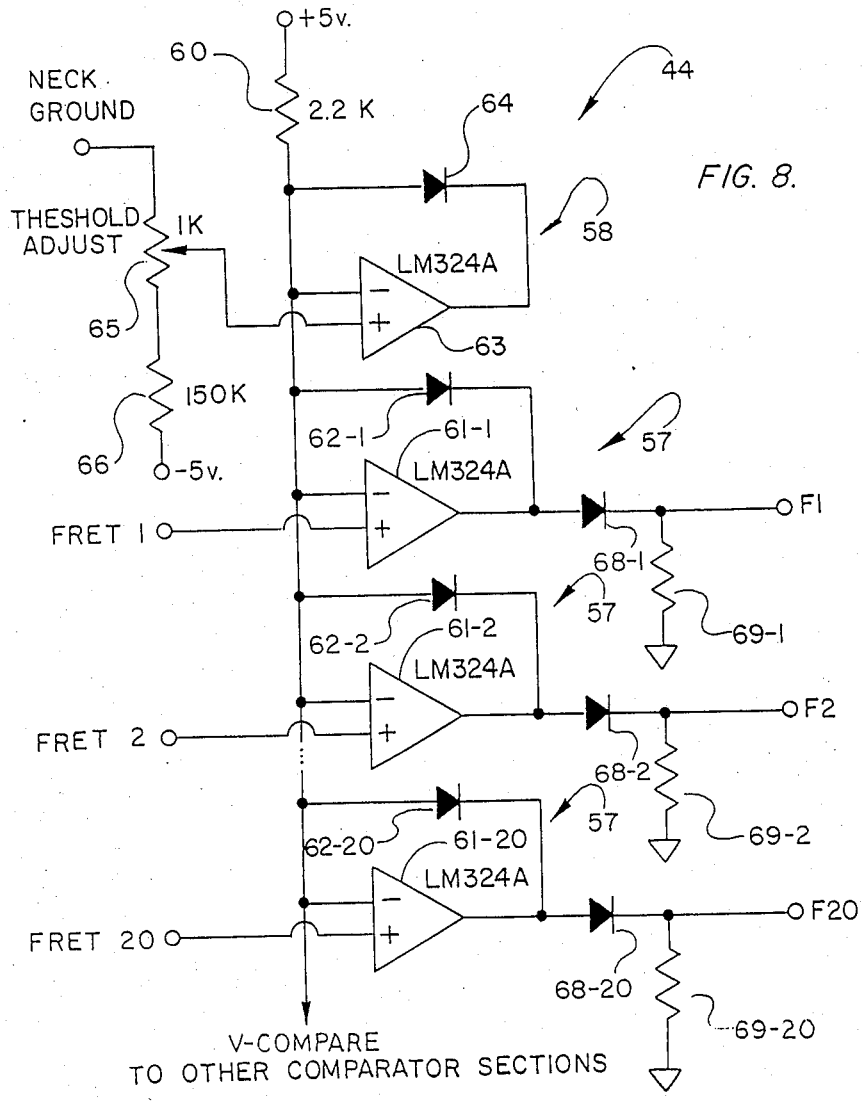
FIG. 8 is a simplified schematic diagram illustrating the fret comparison circuitry.

A typical fret detector circuit for fret detector 44 is shown in FIG. 8 (while only three detectors are shown in FIG. 8, it is to be realized that a like detector is provided for each fret of the stringed and fretted instrument). The overall unit is a multiple-input minimum-seeking comparator consisting of one comparator section 57 for each fret input, and a threshold circuit 58 to handle the special condition when no frets are contacting the selected string.

The comparator sections communicate with each other by a V-COMPARE signal to seek the minimum voltage. The circuit having the lowest fret input voltage drives V-COMPARE down to approximately the same voltage as the input. All other circuits exert no influence on V-COMPARE as long as their inputs are higher than V-COMPARE. Resistor 60 tends to pull V-COMPARE high, up to the point at which one of the comparator sections responds and holds V-COMPARE at a fixed level. In this manner, the circuits successfully discriminate the fret input with the lowest voltage.

Each comparator section consists primarily of an operational amplifier 61 (shown as 61(1) through 61(20) in FIG. 8), and a feedback signal diode 62 (shown as 62(1) through 62(20) in FIG. 8). When the fret input is lower than the inputs to all other sections, the operational amplifier drives its output low, typically to about −0.7 to −0.8 volts. At this point, feedback diode 62 turns on and brings V-COMPARE low, to about −20 to −100 millivolts. The operational amplifier feedback loop thus stabilizes with V-COMPARE approximately matching the fret input.

When the fret input is higher than one or more inputs to other sections, V-COMPARE is forced by another section to a lower voltage than this input. The operational amplifier output is then driven to positive saturation, at about 4 volts. The feedback diode stays off, and this section has no influence on V-COMPARE.

The threshold circuit 58, consisting of amplifier 63 and diode 64, operates in the same manner as the rest of the comparator sections. Its input voltage, however, is set by the threshold adjustment circuit consisting of potentiometer 65 and resistor 66, rather than being connected to any fret, with the input voltage being typically set at about −10 millivolts.

The function of the threshold circuit is to force all other comparator sections off, i.e., inactive, whenever the selected string is not being fingered, and thus is not contacting any of the frets. In this condition, the fret inputs are all at 0 volts (the level of NECK-GROUND). Without the threshold circuit, the operational amplifiers would select a random lowest fret, based on the random variations of the input offset voltage errors of the operational amplifiers. However, the threshold circuit acts as a "lowest fret" in this situation, and thereby causes all frets to signal as off. The ground reference in the threshold adjustment circuit is taken directly from the NECK-GROUND signal, to minimize common ground-path interference from other circuits in the system.

Diode 68 (shown as 68(1) through 68(20) in FIG. 8) and resistor 69 (shown as 69(1) through 69(20) in FIG. 8) comprise an analog-to-digital level converter for each comparator section. When the fret input is lowest, the operational amplifier output is about −0.7 to −0.8 volts (see above), diode 68 is off, and resistor 69 pulls the digital TTL output signals (F1, F2, etc.) down to a logic low level of about 0.2 volts. When the fret input is not lowest, the operational amplifier output is about 4 volts, diode 68 is on, and the output signal is pulled up to a logic high level of about 3.3 volts.

During the fingering and releasing of the strings, variations in string pressure can cause momentary variations in string-fret contact resistance, and thereby variations in the fret voltages. Because of this, two adjacent frets can momentarily have similar voltages, and the comparator will then momentarily indicate both frets on. It is seen from the technique of fingering that the fret closest to bridge 31 is the critical fret in this condition. Therefore, in order to minimize false interpretations from this effect, the control system must give priority to frets closest to bridge 31.

As indicated in FIG. 3, string vibration detecting section 36 includes level detectors 70 connected to receive the outputs of level optical pickups 71 and provide outputs to microprocessor 39 of microcomputer 38. String vibration detecting section 36 is shown in the schematic diagram of FIG. 9. Only one portion is shown, but it is to be realized that identical portions would be provided for each string so that six such portions would be provided for a guitar with six strings, for example.

Figure 9:
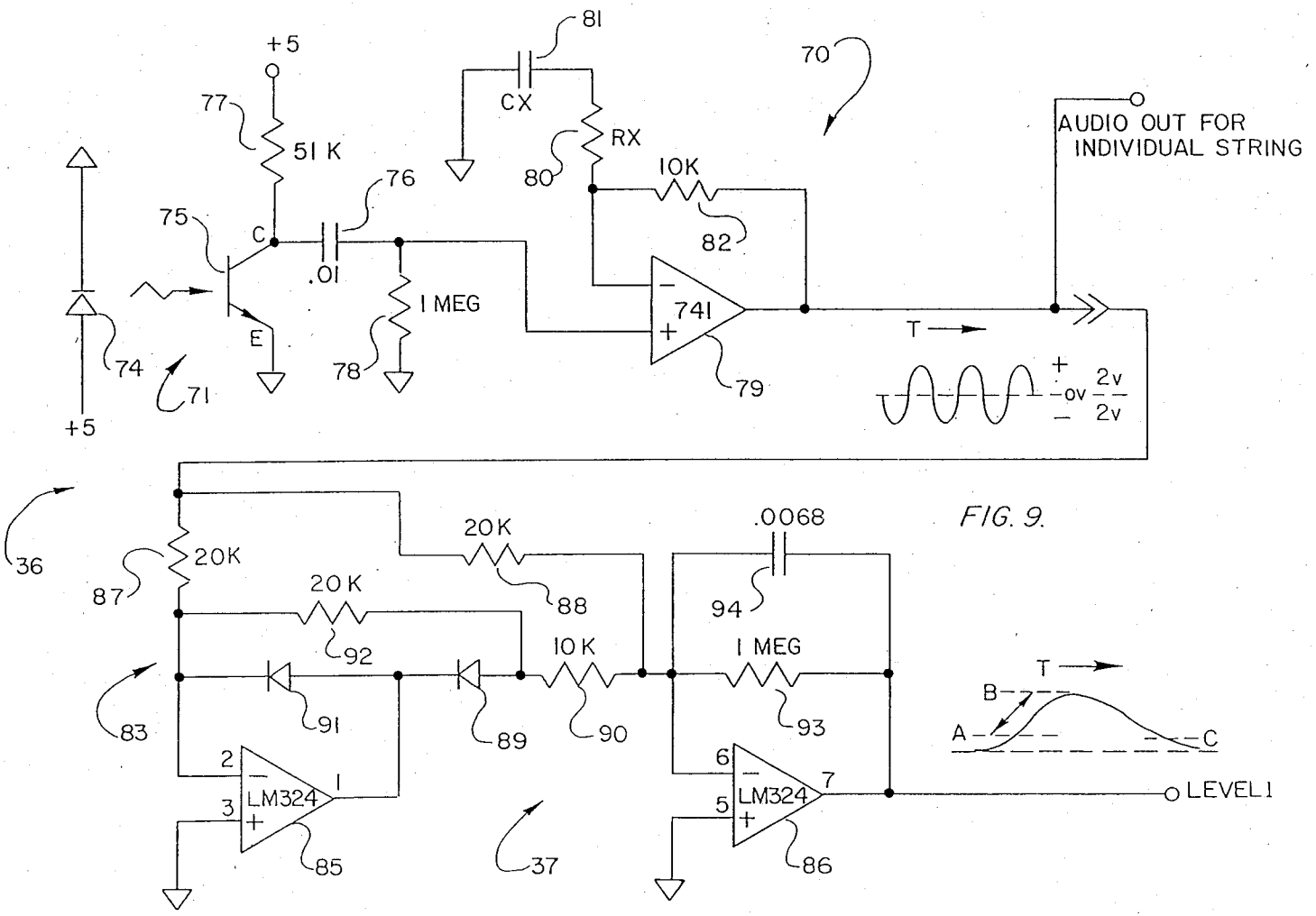
FIG. 9 is a schematic diagram of the string vibration state detector as shown in the block diagram of FIG. 3.

As shown in FIG. 9, a photo-optical pickup 71 is utilized to sense string movement. This pickup may be conventional and may be, for example, a slotted optical switch, type OPB 813, manufactured by Optron, Inc., Carlton, Tex.

Figure 10:
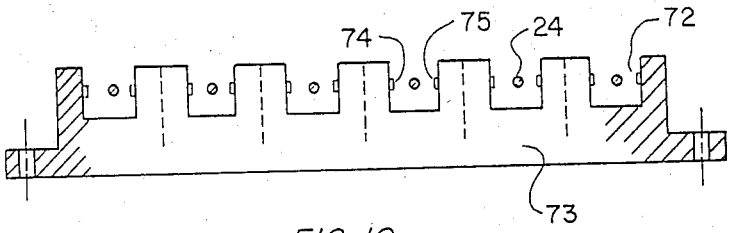
FIG. 10 is a partial end view illustrating string location relative to an optical sensor.

As shown in FIG. 10, photo-optical pickup 71 is positioned adjacent to slot 72 on board 73 so that string 24 intercepts the light emitted by LED 74 (of pickup 71) that is directed toward phototransistor 75 (of pickup 71). Phototransistor 75 is connected through capacitor 76 (having a resistor 77 at one side to the +5 volt power supply and a resistor 78 at the other side to ground) to the positive input of amplifier 79 of level detection circuitry 70. The negative input of amplifier 79 is connected through series connected resistor 80 and capacitor 81 to ground, with the negative input also having a feedback resistor 82 to the output of the amplifier.

The output from amplifier 79 provides an audio output signal and the output is also coupled to detector and analog-to-digital converter section 83. This section includes amplifiers 85 and 86 having resistors 87 and 88 connected to the negative inputs of the amplifiers, with the output of amplifier 85 being connected with the negative input of amplifier 86 through diode 89 and resistor 90, with amplifier 85 having a feedback diode 91 to the negative input, with resistor 92 being connected with the junction of diode 89 and resistor 90 and to the negative input of amplifier 85, and with amplifier 86 having parallel connected feedback resistor 93 and capacitor 94 connected from the output to the negative input.

With a string vibrating, an AC output is provided by the pickup reflecting the frequency of vibrating string with the AC output signal having an amplitude as well as a frequency suitable for use as a "traditional" peripheral guitar signal. A DC signal reflecting amplitude over time is converted by the A/D circuitry 83 and coupled to the microprocessor for interpretation according to the following program: A (as illustrated in the representative waveform in FIG. 9) equals an arbitrary (preprogrammed) "note on" command threshold; C equals an arbitrary (preprogrammed) "note off" command threshold; and B equals peak amplitude.

It is to be understood that interconnection of the pickup 71 to the microprocessor is not necessary to the functioning of fret-string detection section 36 and tone signal production thereof, but is, instead, one useful program mode which preserves to the performer some of the instrument's inherent tactile and expressive qualities.

Figure 11:
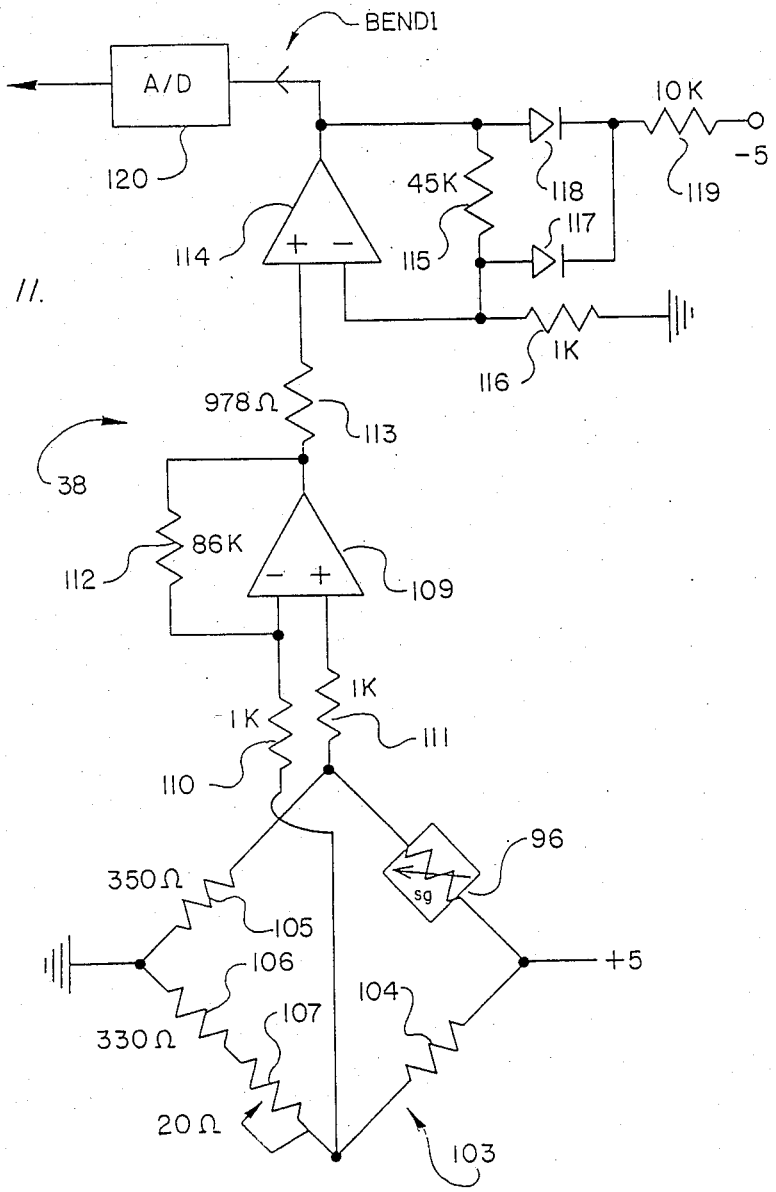
FIG. 11 is a schematic diagram of the bending detector, shown in block diagram of FIG. 3, using a strain gauge.
Figure 12:
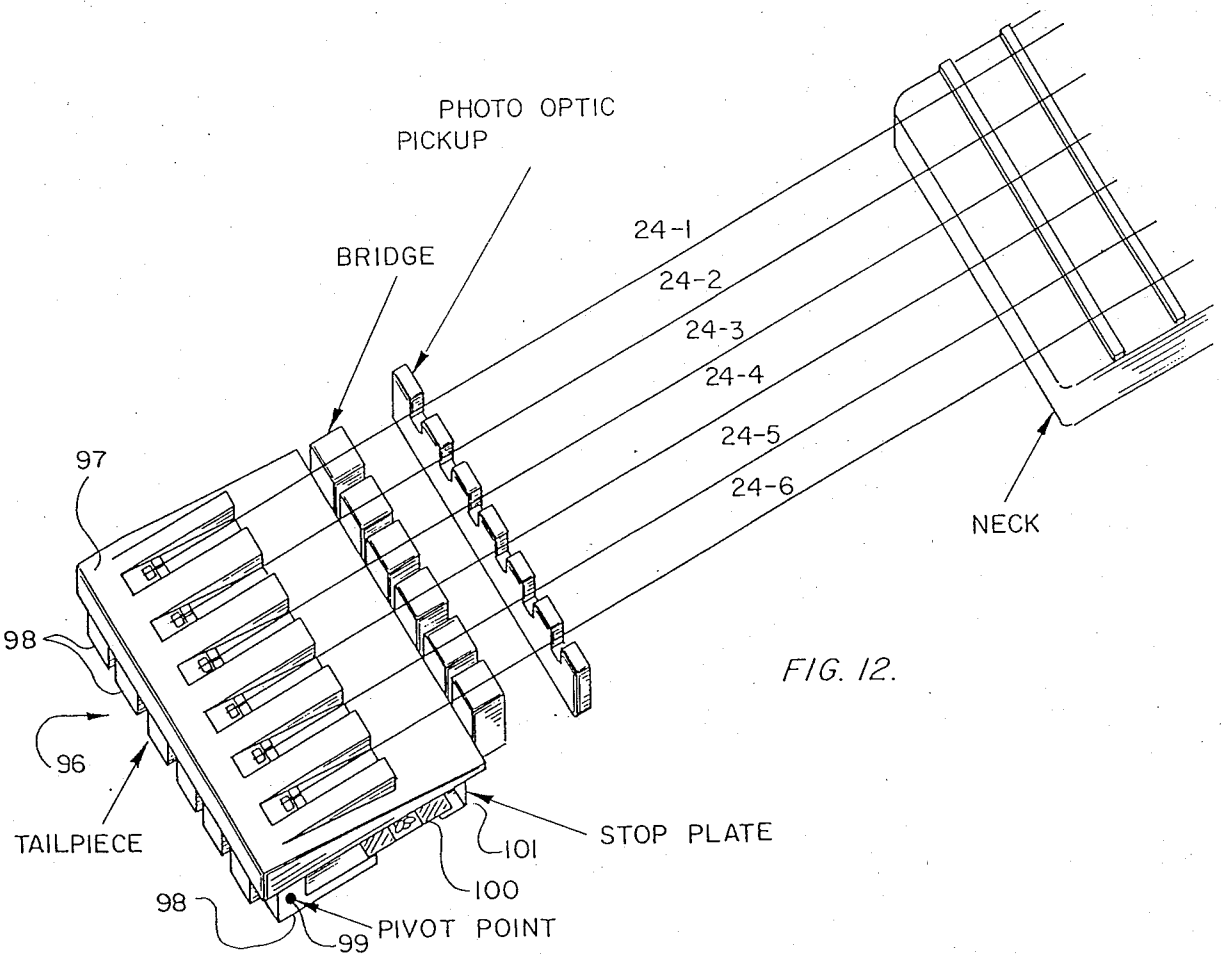
FIG. 12 is a partial perspective view illustrating location and mechanical operation of the strain gauge.

Another optional circuit is illustrated by bend detecting section 37, shown in FIG. 3 to include bend detectors 95 connected to receive the outputs from the strain gauges 96 and to provide outputs to microprocessor 39 of microcomputer 38. Bend detecting section 37 is shown in schematic form in FIG. 11. Here again, only one section is shown, but it is to be realized that separate like sections are provided for each string. As shown in FIG. 11, and more particularly by the perspective view of FIG. 12 showing the mechanical arrangement, strain gauges 96 are utilized to sense bend for each string. Strain gauges 96 may be conventional and may be, for example, EASS 125 AC 350 strain gauges manufactured by Measurements Group, Inc.

As shown in FIG. 12, each strain gauge 96 is preferably mounted on the underside of tail piece 97. L shaped levers 98 (one for each string) are mounted for pivotal movement about pivot rods 99 at the end of the tail piece with one end of each lever being attached to a different string 24 and the other end of each lever being attached to one end of a flat strip of spring steel (separate strips are provided for each string), with the other end of each strip 100 being attached to stop plate 101. Each strain gauge 96 is mounted (as by gluing, for example) on spring steel strip 100 to sense the motion thereof.

As shown in FIG. 11, each strain gauge 96 is connected as one leg of a Wheatstone bridge 103. The other legs of the Wheatstone bridge are made up of resistors 104 and 105 in opposite legs and series connector resistor 106 and variable resistor 107 in the leg opposite the strain gauge. Amplifier 109 is connected to bridge 103 (to detect bridge imbalance) through resistors 110 and 111, with amplifier 109 having a feedback resistor 112 connected to the negative input of the amplifier.

The output of amplifier 109 is coupled through resistor 113 to the positive input of amplifier 114 with amplifier 114 having a feedback resistor 115 to the negative input, with the negative input also having a resistor 116 to ground connected thereat. The opposite ends of resistor 115 are connected to diodes 117 and 118 with the other side of each diode being connected to the −5 volt power supply through resistor 119. The output from amplifier 114 is an analog DC voltage level which signals the amount of pitch bend to the A/D converter 120 which converter provides a digital output to the microprocessor.

With strings 24 at normal tension (or "in tune"), the flat strip of spring steel will be unflexed and the strain gauge glued to it will be at its normal or unstressed ohmage. When the string is bent sideways on the fret board, as is common to produce a higher pitch in the traditinal sense of guitar playing, string tension is also increased at the point at which the string is attached to lever 98. This tension causes the attached flat strip 100 of spring steel to also be increased and thereby flexed so that the ohmage value of the affixed strain gauge is linearly increased. This causes unbalancing of the Wheatstone bridge and transforms the ohmage change to a voltage increase which is converted by the A to D converter circuit and then coupled to the microprocessor.

Figure 13:
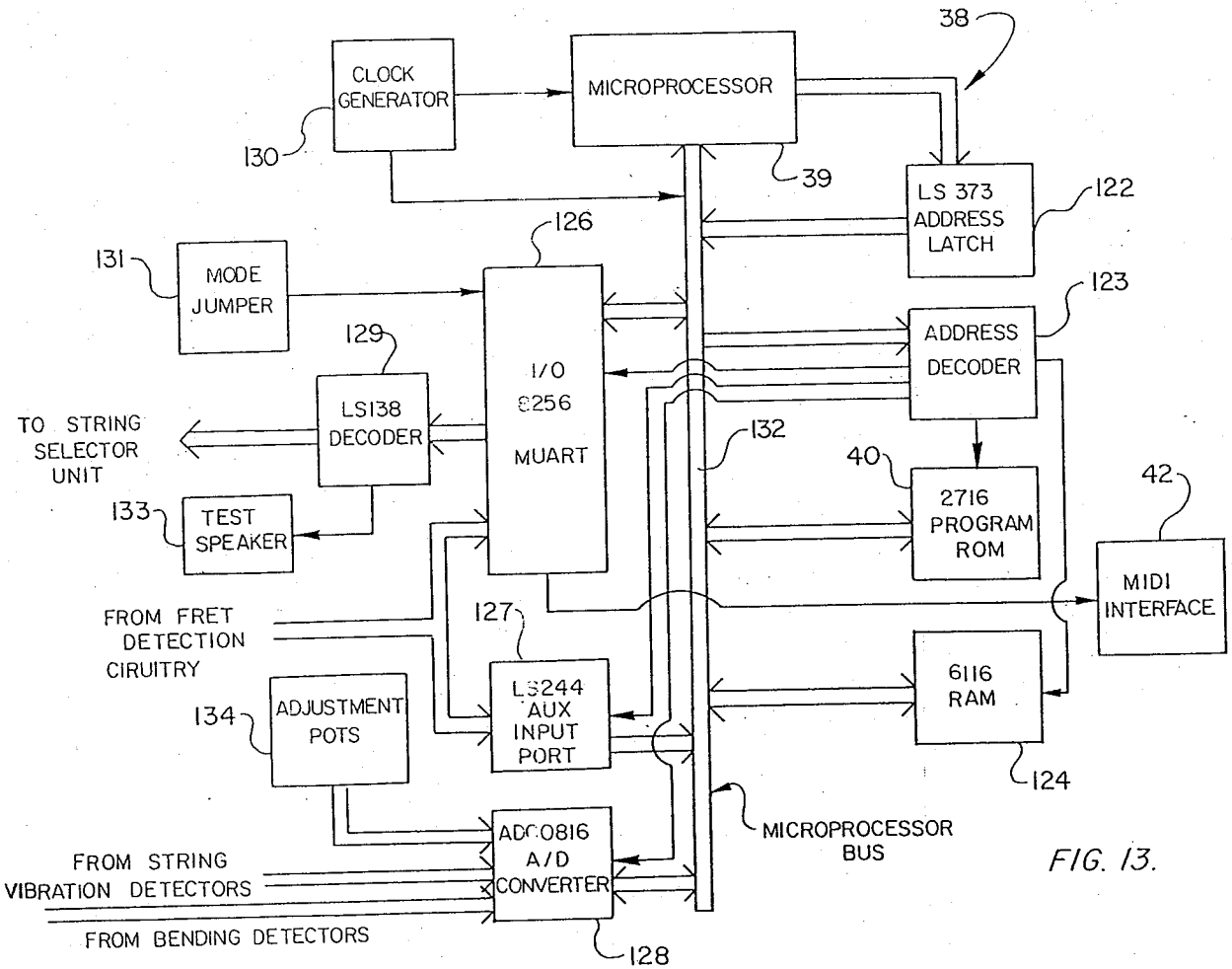
FIG. 13 is a block diagram illustrating in more detail the components of the microcomputer shown in the block diagram of FIG. 3.

The interrelationship of the components of control system 38 and the other elements of the invention are shown in block diagram form in FIG. 13. It may be appreciated that in a conventional fashion, microprocessor 39 supported by address latch 122 and address decoder 123, as a functional block, serves to control the flow of information to and from RAM 124, program ROM 40, the fret detector input port (hereinafter called MUART 126) auxiliary input port 127 and A to D converter 128. Primarily the control information consists of control commands, i.e. when to send or receive information from the microprocessor, and address commands for selection of both the unit and the internal circuitry therein which should be active in sending to or receiving information from the microprocessor.

The essential work performing units of the system include microprocessor 39, program ROM 40, RAM 124, MUART 126 and auxiliary input port 127, decoder 129, and A to D converter 128, in association with the MIDI interface 42.

Clock generator 130 supplies fundamental oscillating digital clock signals to clock the various components including microprocessor 39, MUART 126 and the A to D converter 128. In a conventional way, clock generator 130 is used to sequence operations of the system.

Microprocessor 39, in turn, reads three categories of inputs including program instructions from program ROM 40, information temporarily stored in RAM 124, and sensory information from MUART 126, auxiliary input port 127, and A to D converter 128. Microprocessor 39 sends working data to RAM 124 for temporary storage, information and operating commands to the MUART 126 and A to D converter 128 as well as signals to the address latch 122 and address decoder 123 in addition to read and write control signals referred to above.

Program ROM 40 contains program instructions for use by the microprocessor 39 subject to control and address signals.

MUART 126 may be any one of a number of multifunction universal synchronous receiver/transmitters available commercially, and is more accurately described as a mutlifunction parallel and serial input/output device. MUART 126 receives information from the fret detector circuitry 36 and mode jumper 131 for passage to microprocessor 39, and in turn receives information from microprocessor 39 enabling MUART, as aided by decoder 129, to act as control unit for the string selector circuitry 43. Finally, MUART 126 sends information received from microprocessor 39 to the MIDI interface 42.

Mode jumper 131 is a switch which may be used to instruct the program and microprocessor 39 to operate in a diagnostic mode for the purpose of debugging the circuit or program should the need arise and communicates with microprocessor bus 132 through MUART 126.

MIDI interface 42 translates the signals received from MUART 126 into a signal conforming to MIDI specifications, which is output directly to the synthesizer. MIDI is an interface standard for electronically transmitting musical information to a synthesizer.

Decoder 129 receives digital information through MUART 126 and recodes it for use by the string selector circuitry 43. In addition, it may output to an optional speaker circuit 133, again for use in a diagnostic mode.

Auxiliary input port 127 performs one of the same functions as the MUART 126, in that it receives information from the fret detector circuitry for passage to microprocessor 39. Auxiliary input port 127 is designed for receipt of information from eight of the fret detector circuits while MUART 126 receives information from the remaining twelve.

RAM 124 is a standard memory device for temporary storage of working information and receives input information from microprocessor 39, address latch 122 and address decoder 123, and outputs to microprocessor 39 only.

A to D converter 128 translates analog information from bend detector circuitry 37 and string vibration detector circuitry 36, as well as potentiometers 134, to digital information suitable for use by microprocessor 39.

Turning now to a brief description of the program, string vibration level inputs LEVEL1 through LEVEL6 (as shown in FIG. 9 for LEVEL1 for example) are used to determine when to send MIDI note on and note off commands. Note on is sent when a LEVEL input at the A to D converter is above 0.25 volts for two successive samples of the string. Note off is sent when a LEVEL input goes below 0.20 volts.

A fixed turn-on and turn-off velocity Code is used in note-on and note-off commands, regardless of the LEVEL inputs.

Pitch bend inputs BEND1 through BEND6 (as shown in FIG. 11 for BEND1 for example) at the A to D converter are used to determine when to send MIDI pitch bend commands. The type of MIDI pitch bend command used affects all activated notes as a group; therefore, all BEND inputs are combined to determine what MIDI pitch bend code value to send.

A BEND input is ignored if it is below a threshold value of 0.8 volts. The input is also ignored if a string is off as described above.

BEND input voltages are normally translated on a linear scale, such that an input of 0.8 volts translates to MIDI Code 8192, indicating no pitch bend; an input of 3.5 volts translates to MIDI Code 16383 indicating maximum positive pitch bend. However, this translation is further scaled by a multiplying factor from the pitch bend adjustment potentiometer 134.

The adjustment potentiometer 134 selects a multiplying factor of 0 to 4. When the potentiometer is fully counter-clockwise, its input to the A to D converter 128 is 0.0 volts, which translates to a multiplier of 0. When the potentiometer is fully clockwise, its signal is 5.0 volts, translating to a multiplier of 4. When the potentiometer is one-fourth from counter-clockwise to clockwise, its signal is 1.25 volts, translating to a multiplier of 1. On this setting the unmodified normal translation of pitch bend occurs as described in the preceeding paragraph. This adjustment allows the performer to downscale or exaggerate the pitch bend effect as desired.

After the pitch bend has been translated and multiplied by the adjustment potentiometer 134, it is compared to the current pitch bend last sent to the synthesizer. If the pitch bend for the current string under consideration exceeds the active pitch bend, a new MIDI pitch bend is transmitted. In this manner, the effective pitch bend is determined as the maximum pitch bend of all currently sounding strings.

A lower pitch bend command is sent whenever the maximum string bend sensed during one complete scan of all six strings is found to be lower than the previously active MIDI pitch bend.

The fret detector signals F1–F2 (as shown in FIG. 8) are scanned from the highest to the lowest frets, that is from the bridge to the nut, such that the critical fret is determined to be the active fret closest to the bridge.

The fret number is then combined with a base value for the string under examination to produce the basic MIDI pitch number for that fret-string combination. This number is used in the MIDI note-on and note-off commands, which are primarily triggered by the level sensor as described above.

On occasion, the player will slide the fingering on the string to an adjacent fret without damping the vibrating string. In this case the fret detector information will change while the level sensor continues to indicate note-on. In such a case, when the fret number detected from an active note changes, a note-off command for the old fret is transmitted, followed by a note-on command for the new fret.

Pitch bend does not influence the MIDI pitch numbers transmitted in note-on and note-off commands, and is dealt with exclusively with the MIDI pitch bend command as described above.

As can be appreciated from the foregoing, this invention provides an improved sensing system for a stringed instrument that enables use of the stringed instrument in a manner heretofore unavailable for such instruments.

What is claimed is:

1. An electronic system for an instrument having a plurality of metallic strings and frets and being capable of playing music by vibrating said strings and contacting said strings with said frets, said system comprising:

string vibration sensing means including a plurality of vibration sensors each of which is positioned adjacent to a different one of said strings for sensing vibration of each of said strings during playing of said instrument by a performer, with each of said vibration sensors providing a first output signal indicative of the amplitude of each of said vibrating strings;

pitch sensing means including selection means and detecting means, said selection means connected with said strings for enabling selective energization of each of said strings, and said detecting means connected with each of said frets for detecting by resistive differences the energized string-fret combinations established by contact of said strings with said frets during the playing of said instrument by a performer, said pitch sensing means providing a second output signal indicative of each sensed energized string-fret combination where said contacted fret provides the lowest resistance value for said energized string with respect to any other fret contacted by said energized string so that said second output signal is indicative of the pitch of said energized string;

string bend sensing means including a plurality of string bending sensors each of which is connected with a different one of said strings for sensing bending of each of said strings during playing of said instrument by a performer, with each of said string bending sensors providing a third output signal indicative of pitch variation of each of said strings; and processing means connected with said selection means for determining string selection and connected to receive said first, second and third output signals from said string vibration sensing means, pitch sensing means and string bend sensing means for each said string as selected and responsive thereto providing an output signal for enabling a presentation indicative of the music played by said performer utilizing said instrument.

2. The system of claim 1 wherein each of said vibration sensors includes a photo-optic unit positioned to sense string movement between the light-emitting and light-collecting portions of said unit.

3. The system of claim 1 wherein said selection means includes a plurality of signal generating devices each of which is connected with a different one of said strings for selective energization thereof, and wherein said detecting means includes a plurality of comparators each of which is connected in common to a voltage reference source and with a different one of each of said frets to receive the voltage appearing at a fret contacted by an energized string and with said voltage varying between frets due to the resistance of said energized string with said detecting means providing said output indicative of pitch only from said comparator having the most extreme voltage.

4. The system of claim 3, wherein said detecting means also includes a threshold circuit receiving said reference input and establishing a threshold for maintaining all of said comparators in an off condition until a voltage appears at a fret due to string-fret contact.

5. The system of claim 1 wherein said string bend sensing means includes a plurality of strips of bendable material each of which is connected with a different one of said string bending sensors and a different one of said strings with said strip being caused to be bent each time its associated string is bent, and wherein each of said string bending sensors includes a strain gauge mounted on a different one of said strips of bendable material to sense bending thereof, each of said strain gauges forming one leg of a Wheatstone bridge with unbalancing of said bridge being indicative of bending of that string associated with said strip upon which said strain gauge is mounted.

6. The system of claim 1 wherein said processing means is a microprocessor.

7. An electronic sensing system for an instrument having a plurality of metallic strings and frets and being capable of playing music by vibrating said strings and contacting said strings with said frets, said system comprising:

string vibration sensing means including a plurality of photo-optic sensors each of which is positioned adjacent to a different one of said strings for sensing vibration of each of said strings during playing of said instrument by a performer, with each of said photo-optic sensors providing a first output signal indicative of the amplitude of each said vibrating string;

pitch sensing means including selection means and detecting means, said selection means connected with said strings for enabling selected energization of each of said strings, and said detecting means connected with each of said frets for detecting energized string-fret combinations established by contact of said strings with said frets during playing of said instrument by a performer, said pitch sensing means providing a second output signal indicative of each sensed energized string-fret combination where said contacted fret provides an effective minimum length of said energized string with respect to any other fret contacted by said energized string so that said second output signal is indicative of the pitch of said energized string;

string bending sensing means including a plurality of strain gauges each of which is connected with a different one of said strings for sensing bending of each of said strings during playing of said instrument by a performer, with each of said strain gauges providing a third output signal indicative of pitch variation of each of said strings; and microprocessor means connected with said selection means for determining string selection and connected to receive said first, second and third output signals from said string vibration sensing means, pitch sensing means and string bend sensing means for each said string as selected and responsive thereto providing an output suitable for enabling a presentation indicative of the music played by said performer utilizing said instrument.

8. The system of claim 7 wherein said detecting means detects said energized string-fret combinations by detecting resistive differences, and wherein said detecting means provides an output for each energized string-fret combination only if said contacted fret provides the lowest resistance value as measured from said selection means for said energized string with respect to any other fret contacted by said energized string.

9. The system of claim 7 wherein said instrument has a body portion, and wherein said system includes mounting means for mounting said microprocessor means within said body portion of said instrument.

10. The system of claim 7 wherein said output from said microprocessor means is coupled to a synthesizer for presentation of said music.

* * * * *